US009394076B2

(12) United States Patent
Hengami

(10) Patent No.: US 9,394,076 B2
(45) Date of Patent: Jul. 19, 2016

(54) EASY DISPENSING BOX WITH TOP SLIDE OPENING

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

(21) Appl. No.: 14/804,262

(22) Filed: Jul. 20, 2015

(65) Prior Publication Data

US 2015/0321788 A1 Nov. 12, 2015

Related U.S. Application Data

(63) Continuation-in-part of application No. 12/686,252, filed on Jan. 12, 2010, now Pat. No. 9,085,386.

(51) Int. Cl.

| | |
|---|---|
| ***B65D 5/64*** | (2006.01) |
| ***B65D 5/72*** | (2006.01) |
| ***B65D 5/42*** | (2006.01) |
| ***B65D 5/02*** | (2006.01) |

(52) U.S. Cl.

CPC ..... *B65D 5/723* (2013.01); *B65D 5/0227* (2013.01); *B65D 5/4266* (2013.01); *B65D 5/646* (2013.01); *B65D 5/72* (2013.01)

(58) Field of Classification Search

CPC ..... B65D 5/723; B65D 75/5894

USPC ..... 229/129.1, 131.1, 220, 125.12, 210, 229/125; 493/150; 206/540, 536, 468; 220/345.3, 345.2, 345.1

See application file for complete search history.

(56) References Cited

U.S. PATENT DOCUMENTS

| | | | | |
|---|---|---|---|---|
| 1,951,274 | A | 3/1934 | Denman | |
| 2,330,926 | A | 10/1943 | Rous | |
| 2,507,430 | A | 5/1950 | Yancey | |
| 2,983,421 | A | 5/1961 | Turpin | |
| 3,040,953 | A | 6/1962 | Tindall | |
| 3,126,141 | A | 3/1964 | Walter | |
| 3,229,888 | A | 1/1966 | Gillam | |
| 3,303,436 | A | 2/1967 | Peimer | |
| 3,819,093 | A | 6/1974 | Forbes et al. | |
| 4,081,128 | A | 3/1978 | O'Neill | |
| 4,094,456 | A * | 6/1978 | Raccaforte ..... | B65D 5/723 229/125.12 |

(Continued)

OTHER PUBLICATIONS

PCT International Search Report and the Written Opinion of the International Searching Authority.

*Primary Examiner* — Christopher Demeree

(74) *Attorney, Agent, or Firm* — Robert J. Lauson; Lauson & Tarver LLP

(57) ABSTRACT

A package for solid pourable product includes a blank one-piece pattern having several flaps, several side panels and a slide. The slide has an upper portion and a lower portion. The upper portion is connected to a top flap and the lower portion extends into the box. A support is provided, connected to a flap of the box, for resiliently engaging the lower portion. One of the side panels has an opening covered by the lower portion. The support holds the lower portion against the opening when the slide is closed. Preferably the lower portion slides between the support and the panel having the opening. The fold line between second top flap and the support is set back from the panel having the opening thereby helping the support resiliently push against the lower portion.

20 Claims, 14 Drawing Sheets

(56) References Cited

U.S. PATENT DOCUMENTS

| | | | | |
|---|---|---|---|---|
| 4,141,485 | A * | 2/1979 | Lambert | B65D 5/723 222/529 |
| 4,197,985 | A | 4/1980 | Austin | |
| 4,609,142 | A | 9/1986 | Adamek | |
| 5,348,219 | A | 9/1994 | Brintazzoli | |
| 5,505,373 | A | 4/1996 | von Stillfried | |
| 5,725,620 | A | 3/1998 | Perea et al. | |
| 6,116,499 | A | 9/2000 | Todjar-Hengami | |
| 6,273,332 | B1 | 8/2001 | Todjar-Hengami | |
| 6,360,942 | B2 | 3/2002 | Todjar-Hengami | |
| 6,435,402 | B1 | 8/2002 | Hengami | |
| 6,733,555 | B1 | 5/2004 | Wilder | |
| 6,945,449 | B2 | 9/2005 | Hengami | |
| 7,040,528 | B2 | 5/2006 | Hengami | |
| 7,156,286 | B2 | 1/2007 | Hengami | |
| D551,976 | S | 10/2007 | Daniels | |
| 7,337,904 | B2 | 3/2008 | Hengami | |
| 7,743,973 | B2 | 6/2010 | Hengami | |
| 2005/0067476 | A1 | 3/2005 | Hengami | |
| 2006/0124709 | A1 | 6/2006 | Hengami | |
| 2008/0128480 | A1 | 6/2008 | Hengami | |
| 2011/0168767 | A1 | 7/2011 | Hengami | |

* cited by examiner

EASY DISPENSING BOX WITH TOP SLIDE OPENING

This application is a continuation-in-part, and claims the benefit of the priority filing date of U.S. utility application Ser. No. 12/686,252, now issued as U.S. Pat. No. 9,085,386.

BACKGROUND

Clever packaging for solid pourable products, offering improved functionality, appeals to customers. Applicant's specialty boxes with slide openings enable convenient dispensing of contents, and thus provide food manufacturers a competitive advantage. Applicant is the owner of von Stillfried U.S. Pat. No. 5,505,373 for a "Folding Package," and is the named inventor on numerous issued U.S. patents for specialty packaging including U.S. Pat. Nos. 6,116,499, 6,273,332, 6,360,942, 6,435,402, 6,945,449, 7,040,528, 7,156,286, D551,967 and 7,337,904, as well as U.S. Patent Application Publication No. 2008/0128480 for a "Thumb-Actuated Candy Or Mint Box."

Although for a time Applicant licensed the von Stillfried patent for use on Certs® mints boxes, Applicant's specialty boxes have otherwise yet to be widely distributed. The primary reason has been difficulty in manufacturing Applicant's boxes on a mass production scale. Major food or candy manufacturers have high-speed form, fill and seal packaging machines which produce hundreds of boxes of product per minute. These machines take partially-constructed boxes, fold and seal one end, then fill the boxes, and finally told and seal the opposite end thereby completing the manufacturing.

Early on several of Applicant's box designs with slide openings needed multiple pieces of cardboard to produce, which was disadvantageous. Further. Applicant's boxes have typically required an insertion step or inserting of the slide member in between or adjacent other side panels of the box. This insertion step cannot be easily accomplished by various food or candy manufacturers without significant changes or new high-speed equipment. Therefore given the heavy investment in their hundreds of expensive machines, major manufacturers have been unwilling to adopt Applicant's new box designs, despite the improvements offered in easier dispensing of the pourable food items for customers.

In the "Thumb Activated Candy Or Mint Box" application identified above, Applicant developed a box with a slider from a single sheet of blank stock not requiring the insertion step. The slider moves in a sideways direction perpendicular to the top opening of the box, however, meaning this box differs some from conventional boxes in appearance and operation. Accordingly, Applicant has continued to develop boxes of new and superior functionality which offer improvements over the prior art including in ease of manufacturing and use.

For the foregoing reasons, there remains a need for a box that offers a convenient slide opening for easy dispensing of product, that is easy to manufacture on a mass production scale using conventional high-speed packaging machines, and that is constructed in such a way to avoid any insertion step. There is further a need for a box incorporating a slide opening having the same appearance and handling characteristics as a conventional box, wherein the top flap is lifted to dispense the contents. The improved box should be made from a single sheet of blank stock.

There is also a need for box that incorporates a slide opening as well as incorporating a support for holding the slide against the opening, thus preventing spillage of pourable product from the opening when the slide is closed. Also, there is a need for a box incorporating a slide and a support that can be folded while avoiding any insertion step. Finally, there is a need for a box incorporating a slide and a support, that can also be quickly and fully opened at the top of the box if desired.

SUMMARY

A package for solid pourable product includes a blank stock defining a one-piece pattern. The blank has several flap portions extending from several longitudinally extending side panels. The flap portions of the blank fold relative to the longitudinally extending side panels, and define top and bottom flaps and a slide.

Some flap portions of the blank pattern terminate at free edges. Adjacent flaps have opposing free edges, and the free edges and opposing free edges are separated by a taper formed along at least one of the opposing free edges. The slide includes an upper portion connected to a lower portion. The upper portion folds relative to the lower portion. The upper portion is also connected to a first top flap of the box. The upper portion folds relative to the first top flap as well.

A support is provided for engaging the lower portion. The support is connected to a flap of the box, and folds relative to the flap of the box. One of the side panels has an opening adjacent the first top flap for the box. The opening is covered by the lower portion, and the flap of the box is adhesively connected to the first top flap so that the support holds the lower portion against the opening when the slide is closed.

Preferably the lower portion slides between the second top flap and the panel having an opening. A fold line between second top flap and the support is set back from the panel having an opening, to resiliently push against the lower portion. The support may include one or more lobes that contact the lower portion for the least surface area contact.

Preferably the upper portion overlies the second top flap, and they may be adhesively sealed together. In certain embodiments the opening may be jellybean shaped, the box may be a tube box constructed to lay flat upon opening the top and bottom flaps, and the top and bottom flaps of the box may be sealed closed by an adhesive.

The box preferably has two or more major panels and two or more minor sides, with the opening located in one of the minor sides of the box. The slide preferably includes a stop member to contain at least a portion of the slide inside the box, and the slide preferably includes and is lifted using a thumb tab.

DESCRIPTION

Figure 1:
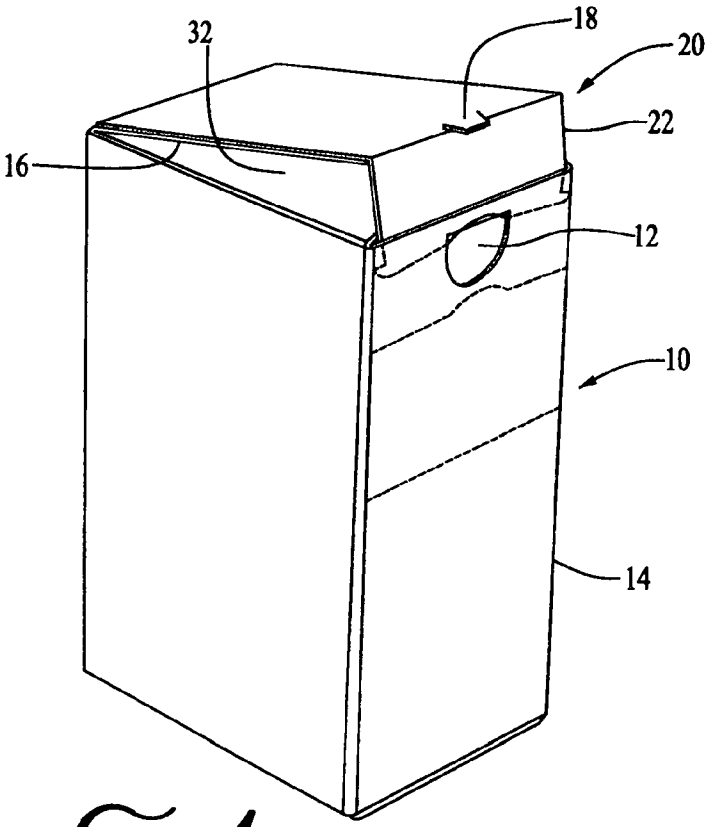
FIG. 1 is a perspective view of a preferred embodiment, shown with the slide open, to enable convenient dispensing of the product through a minor side of the box.
Figure 2:
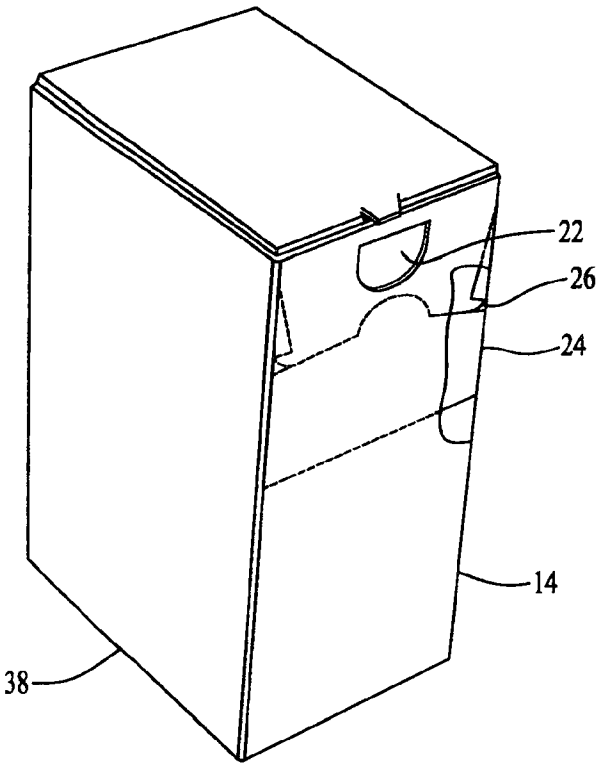
FIG. 2 is a perspective view of the same box with the slide in a closed position.
Figure 4:
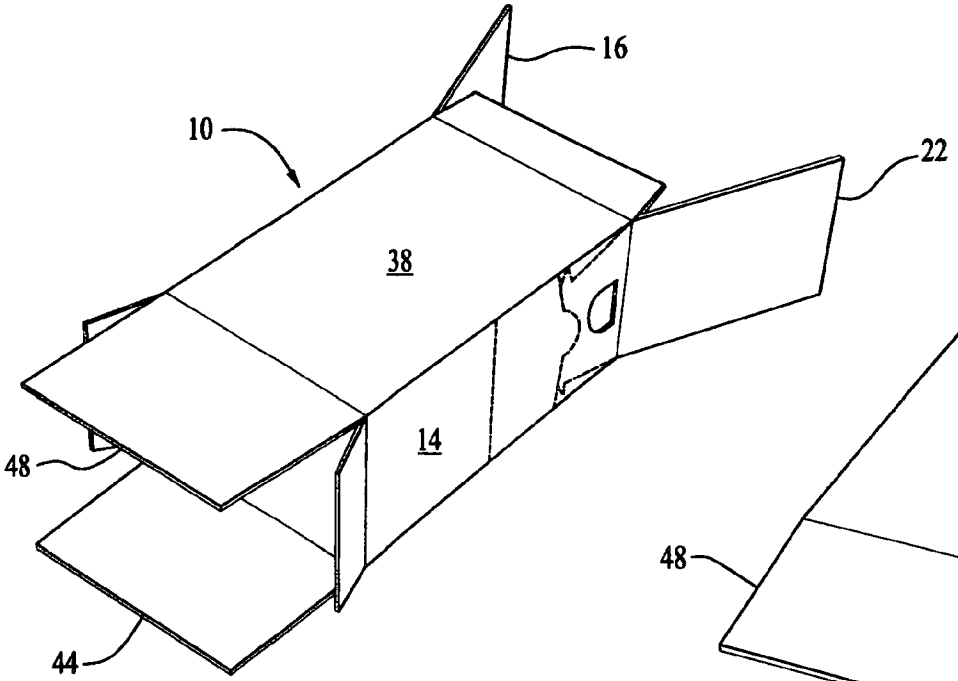
FIG. 4 is a perspective view showing the constructed tube box, with the open top and bottom.

Referring to FIG. 1, the preferred embodiment easy-dispensing box is depicted. The opening 12 is in a minor side 14 of the box. In FIG. 1, the top 16 of the box has been lifted, preferably by the thumb tab 18, such that the slide 20, namely the upper portion 22, has been moved upward so that it no longer covers the opening 12. The box 10 can be inverted, and the contents (not shown) poured through the opening 12. A lower portion 24 of the slide 20 is located inside the box 10 behind the minor side or panel 14, and thus is shown in phantom. Also note the upper portion 22 of the slide 20 has a pair of stop members 26, 28, which catch on the top flaps 32, 24 (see FIG. 4), and thus prevent the slide 20 from being separated from the box 10. FIG. 2 illustrates the slide 20 in a closed position, with the upper portion 22 adjoining the lower portion 24 and blocking the opening 12 in the side 14, such that the contents may no longer be poured out of the box 10.

Figure 6:
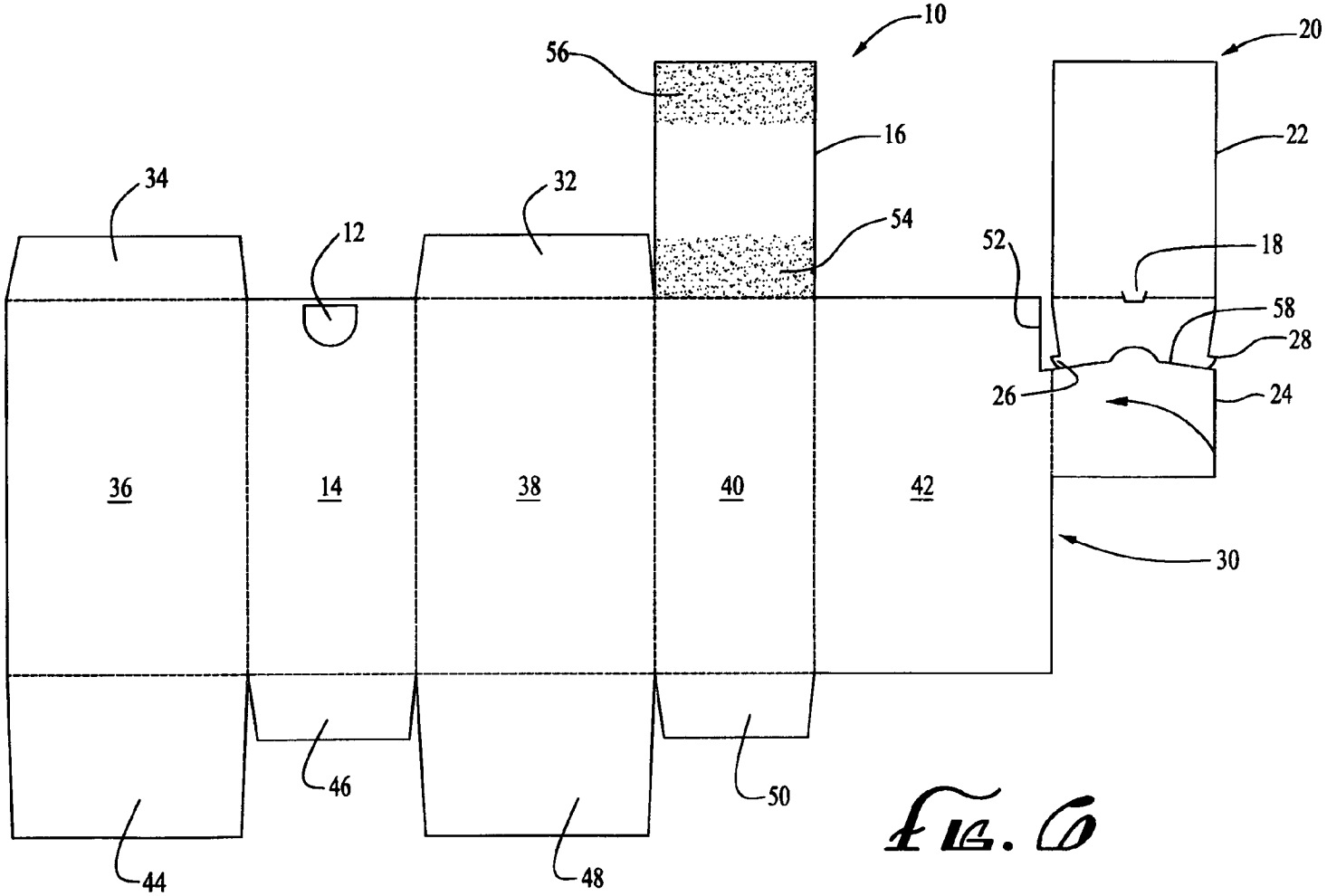
FIG. 6 is a flat pattern view of the blank stock from which the same box is made.

FIGS. 3-6 show initial construction of the tube box 10 from a blank stock 30 paperboard, cardboard or the like, and the folding and gluing operations at the manufacturer's joint, and flattening for delivery to the packaging line. Preferably several thousand tube boxes would be partially constructed and flattened (FIG. 5), for delivery to the high speed production line for filling and completion of the box 10. Referring to FIG. 6, the blank stock 30 is a single sheet cut into the flat pattern shown, with major sides or panels 36, 38 and 42 (the manufacturer's joint), and minor sides 14, 40. Minor side 14 includes the opening 12, which could take on a variety of sizes and shapes depending upon the contents to be poured from the box 10. The top of the box includes the top side 16, which preferably has a pair of glue areas 54, 56, to which the upper portion 22 of the slide 20 is adhered to, in the process of folding and constructing the box. Further there are optional "dust" flaps 32, 34. The paperboard or cardboard 30 is "nicked" or perforated 58 between the upper 22 and lower 24 portions of the slide 20 for easy separation. The bottom of the box 10 also includes sides 44, 48 and flaps 46, 50, which are preferably glued together once the contents are added to the box.

Figure 3:
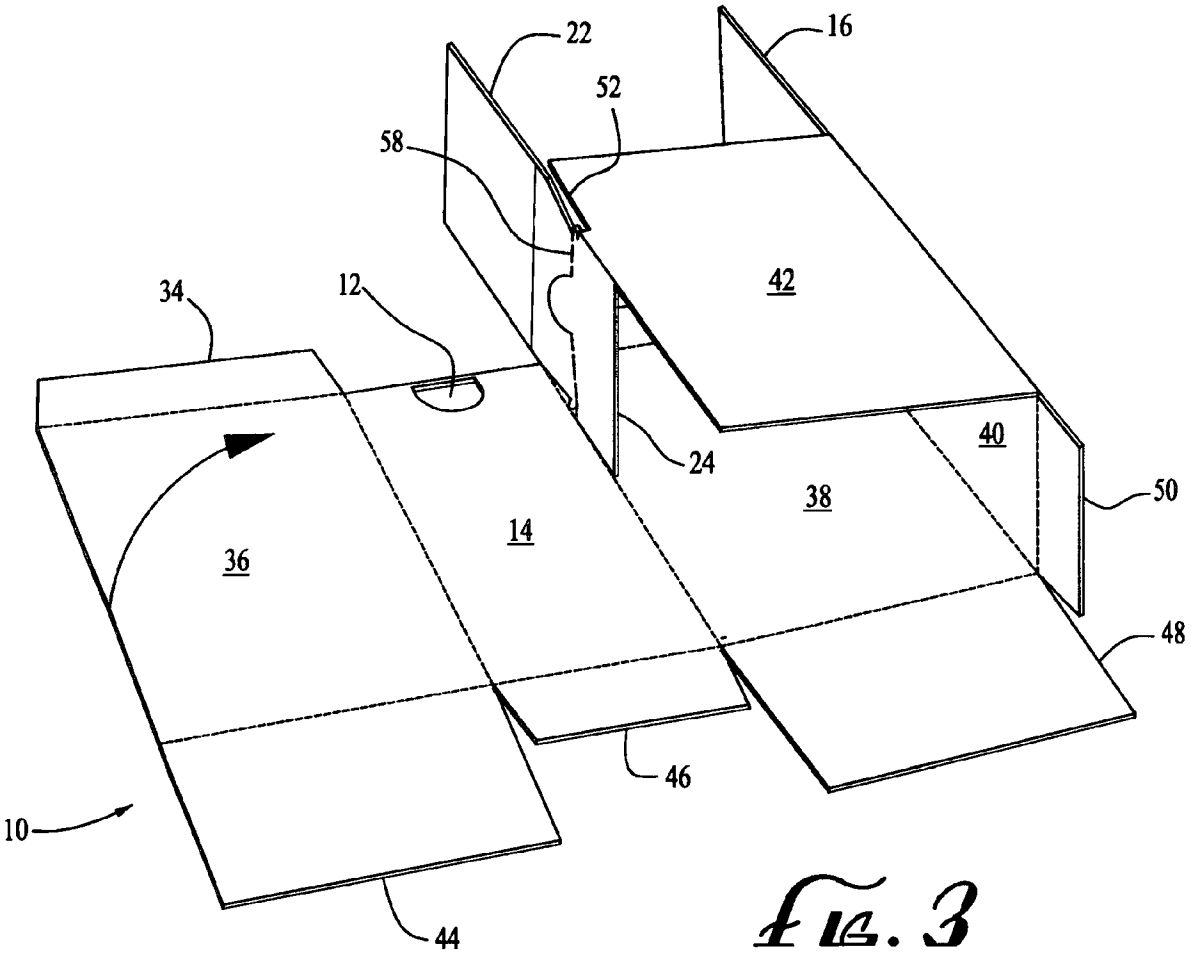
FIG. 3 is a perspective view showing folding of the same box.
Figure 5:
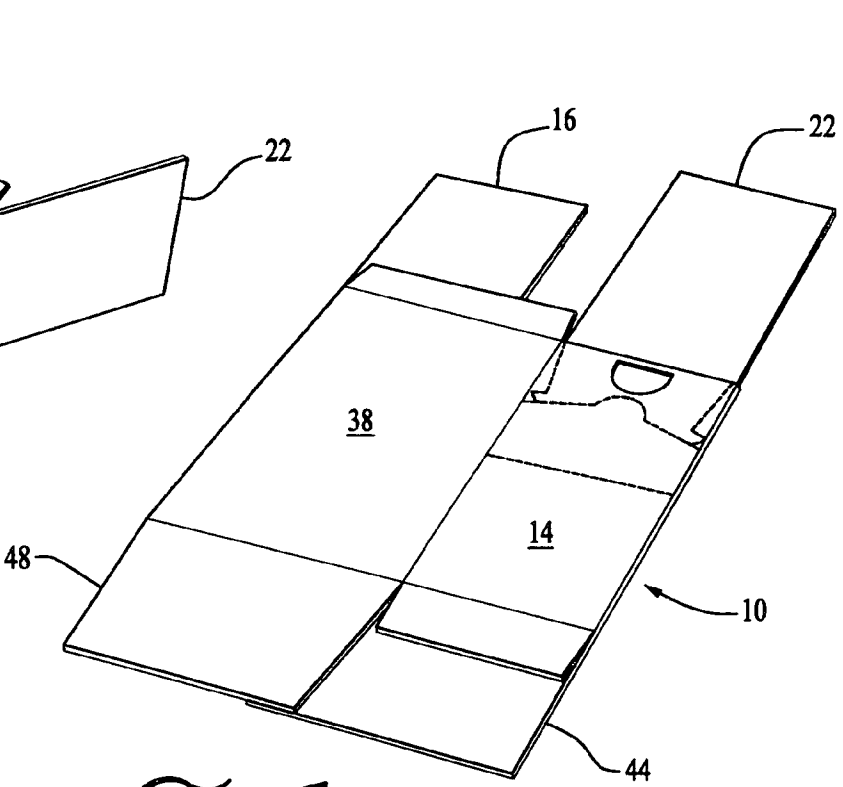
FIG. 5 is a perspective view of the tube box in a flattened position.

Now referring to FIG. 3, the initial folding of the box is shown. As indicated by the arrow in FIG. 4, a first step may be folding the slide 20 to be at a right angle 90 degrees to the adjoining major side 42 (manufacturer's joint). Then, continued 90 degree folds in the same direction, as indicated by FIG. 3 and the arrow shown, forming the tube box 10 of FIG. 2. Glue would also typically be applied to the manufacturer's joint 42 in initial construction of the box into the flattened configuration shown in FIG. 5. Usually, the top part of the box 10 would be constructed and the bottom left open, the contents added, and the bottom flaps 46, 50 and sides 44, 48 closed and sealed, by food manufacturer's high speed fold, form and seal packaging machines. Those standard operations are shown in FIGS. 2-5 of Applicant's pending application for "Thumb-Actuated Candy Or Mint Box," U.S. publication no. 2008/0128480. Optionally, the bottom of the box 10 could be sealed first, and the food product added through the top and then the top sealed.

Figure 7:
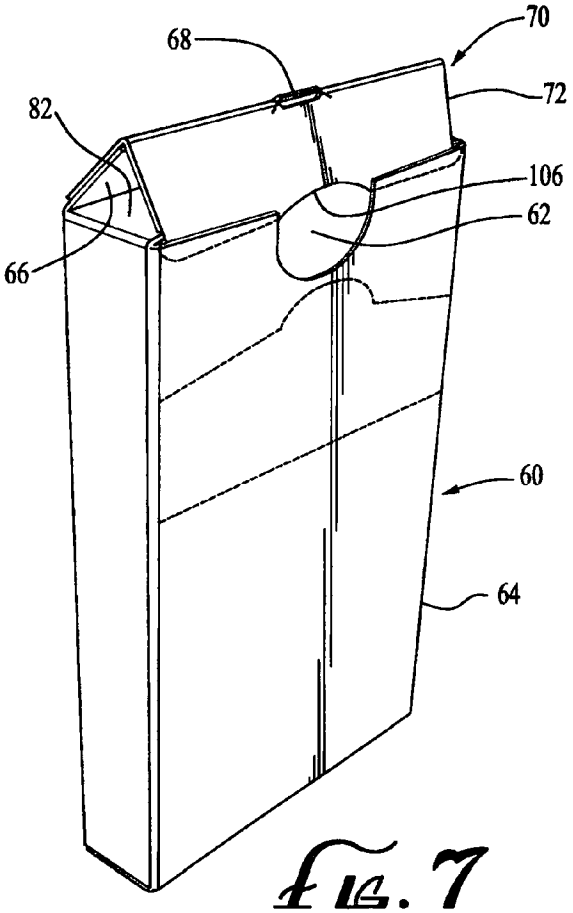
FIG. 7 is a perspective view of an alternate embodiment where the slide opening is on a major side of the box.
Figure 8:
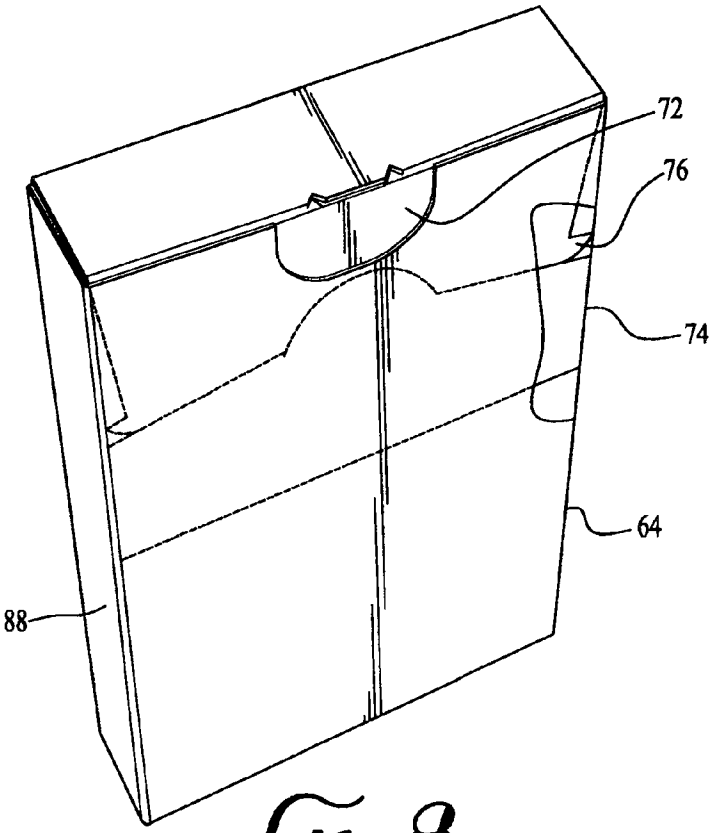
FIG. 8 is a perspective view of the same box with the slide closed.

An alternate embodiment box 60 is shown in FIGS. 7-12, in which the opening is a cutout 62 in a major side 64 of the box 60, rather than in the minor side 14 of the box 10 described above. The configuration and operation of this box 60 is similar to the box 10 previously disclosed, although this embodiment 60 has the advantage of requiring less of the paperboard or cardboard 80 material. FIG. 7 shows the box 60 in an open position, the upper portion 72 of the slide 70 (combined with the top side 66 of the box 60) having been separated from the lower portion 74 of the slide 70 and moved upward, such that it no longer blocks the cutout opening 62 in major side 64. FIG. 8 shows the box 60 back in the closed position.

Figures 9, 10:
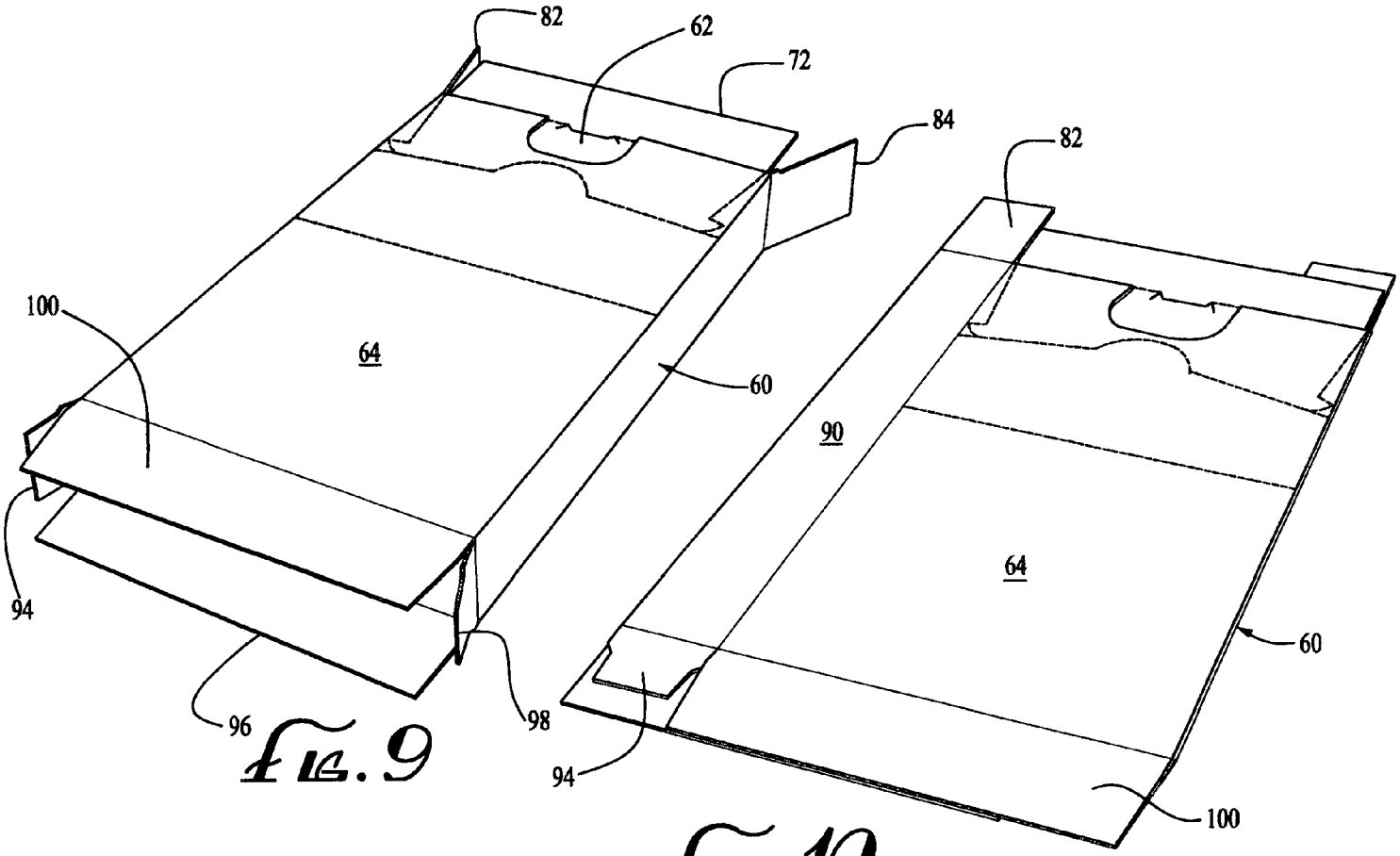
FIG. 9 is a view of the alternate embodiment during construction with the sides folded together forming a tube box.
FIG. 10 is a perspective view of the alternate embodiment tube box in the flattened position.
Figure 11:
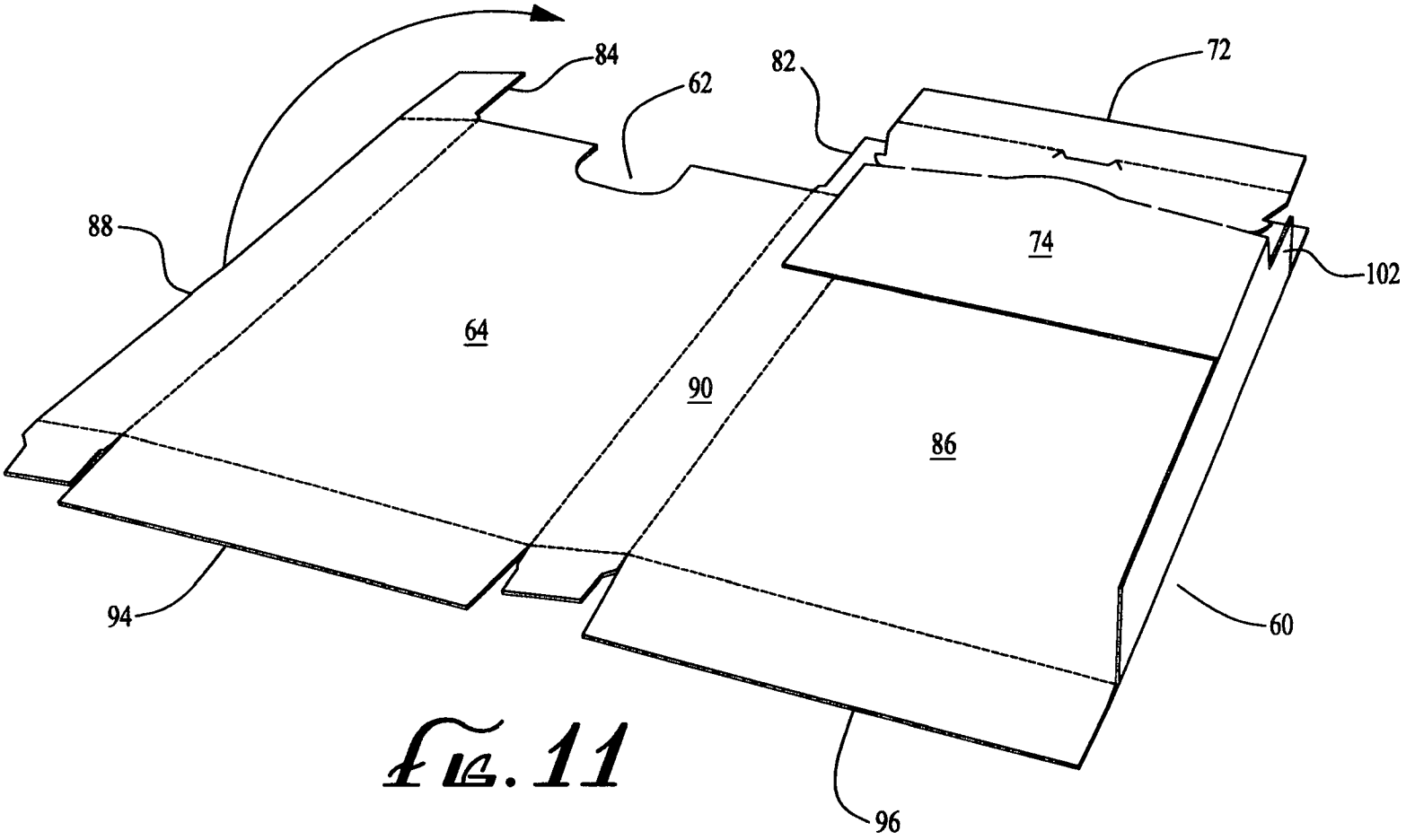
FIG. 11 is a perspective view showing the folding operation of this box.
Figure 12:
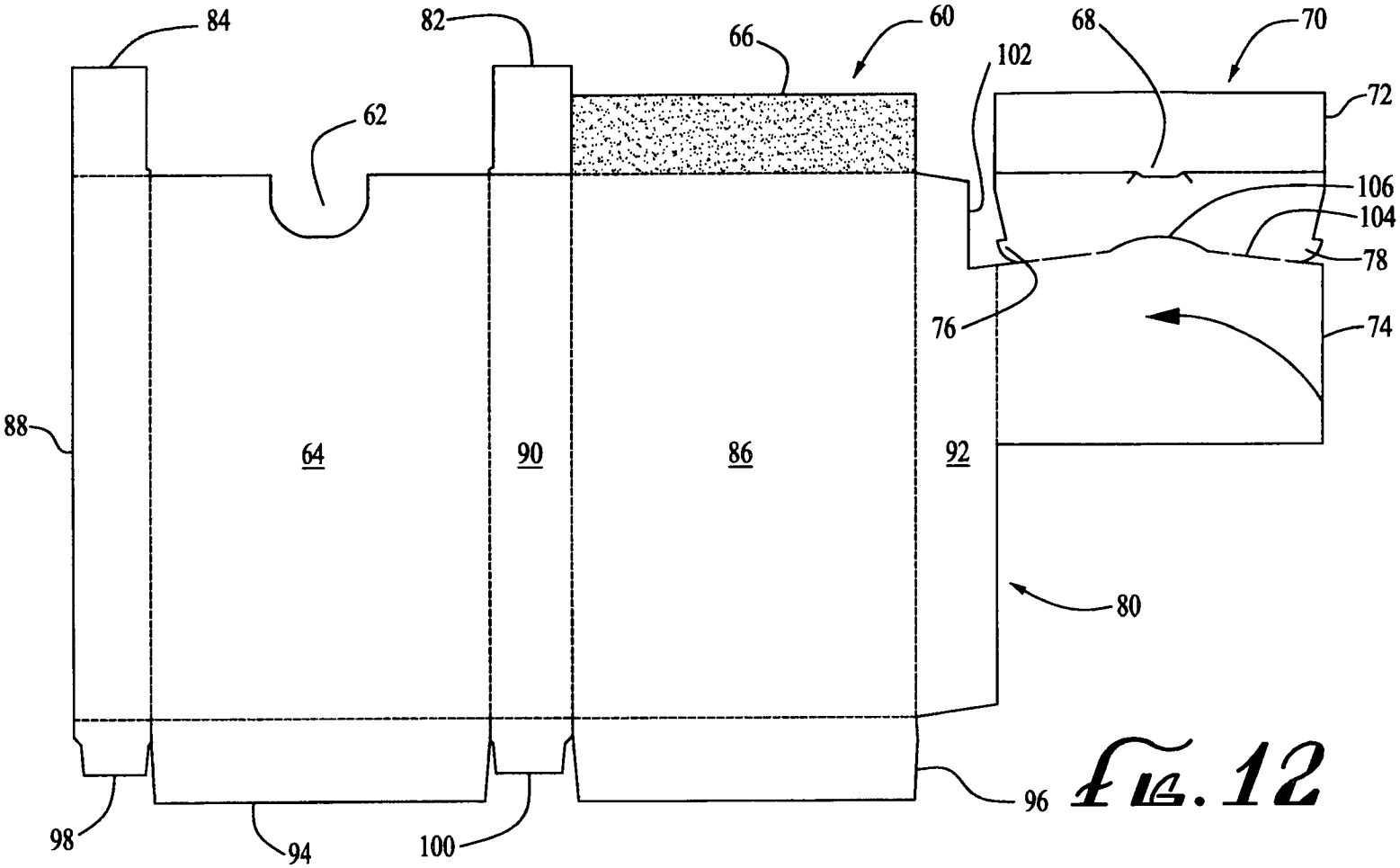
FIG. 12 is a flat pattern view of the alternate embodiment box before the folding operations.

FIG. 12 illustrates the flat pattern blank 80, including major sides 64, 86, minor sides 88, 90, 92 (manufacturer's joint), top side 66, top flaps 82, 84, bottom sides 94, 96 and bottom flaps 98, 100. Additionally, part of the blank flat pattern 80 is slide 70, including upper portion 72, lower portion 74, and the perforated line 104 between the two. Note the curved portion 106 of the upper portion 72 of the slide 70 defines the upper edge of the opening 62 for this embodiment box 60. FIGS. 9-12 show the construction of the box 60, with the arrow in FIG. 12 indicating folding of the slide 70 ninety degrees towards the minor side 92. Subsequent folding steps are indicated by FIGS. 9-11 to form the tube box 60, which is then preferably glued at the manufacturer's joint 92 and flattened (FIG. 10) for delivery to the high speed production line.

Referring to FIGS. 13-20, an improved alternative embodiment package is shown.

Figure 13:
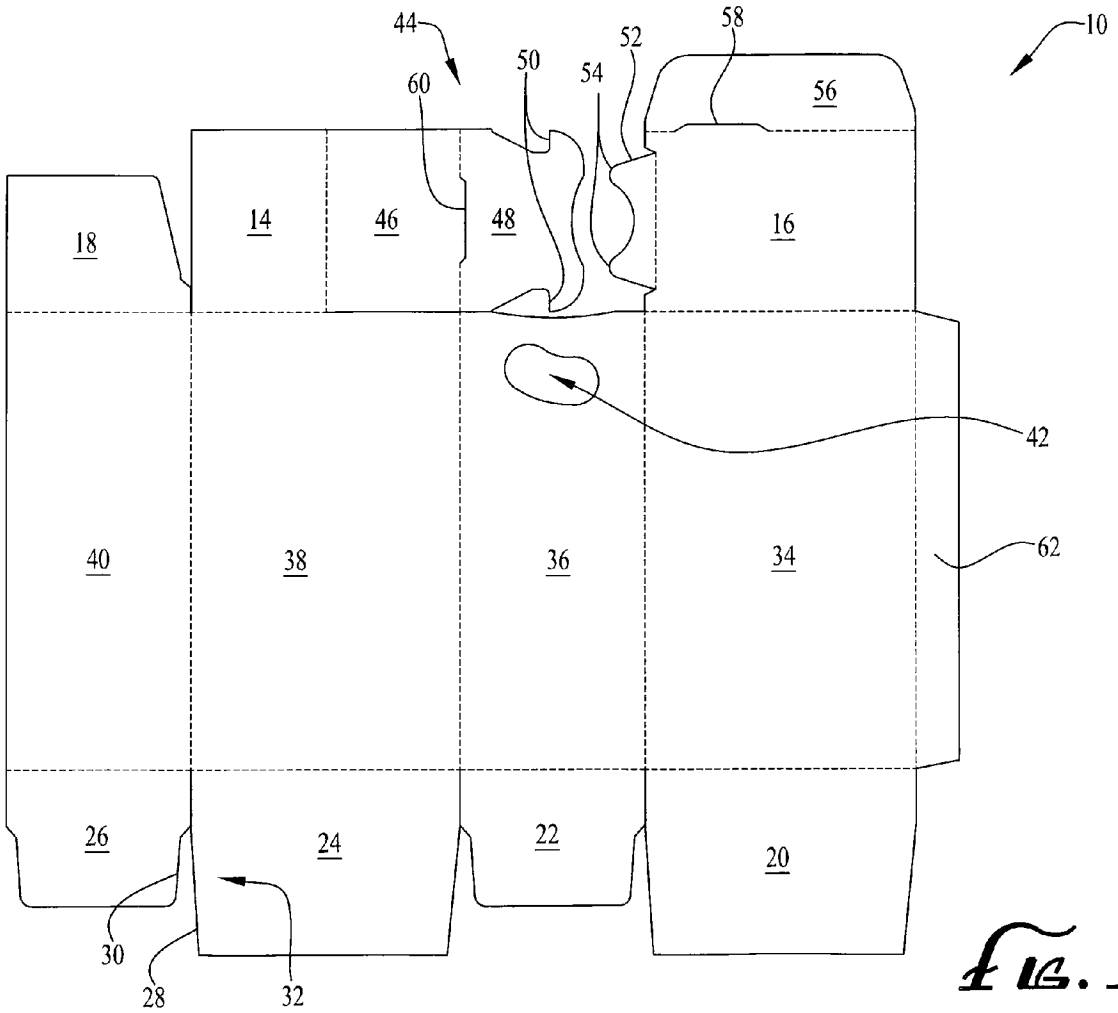
FIG. 13 illustrates a flat pattern view of a blank stock from which an improved easy dispensing box having a top slide opening is made.

FIG. 13 shows a blank 10 of stock for forming an improved box 12 (see FIGS. 15-20). The blank 10 includes a first top flap 14, a second top flap 16 and a third top flap 18. Also included are a first bottom flap 20, second bottom flap 22, third bottom flap 24, and fourth bottom flap 26. In the illustrated embodiment, the first bottom flap 20 and third bottom flap 24 are substantially the same size, as are the second bottom flap 22 and fourth bottom flap 26. In contrast the first top flap 14, second top flap 16, and third top flap 18 are all uniquely shaped and of different sizes. The third top flap 18 and all bottom flaps 20, 22, 24, 26 preferably include free edges 28, that together with opposing free edges 30 form a taper 32, allowing them to be easily and quickly folded without the risk of jamming in a cartoner (not shown) or similar folding machinery.

The blank 10 also has a first side panel 34, second side panel 36, third side panel 38 and fourth side panel 40. The first side panel 34 extends longitudinally between, and is foldably connected to the first bottom flap 20 and the second top flap 16. The second side panel 36 includes an opening 42 sized to dispense a solid pourable product (not shown). The second side panel 36 is foldably connected to the second bottom flap 22, but has no top flap. The third side panel 38 extends longitudinally between, and is foldably connected to the third bottom flap 24 and first top flap 14, and the fourth bottom panel 40 extends longitudinally between, and is connected to the fourth bottom panel 26 and third top flap 18.

A slide 44 mechanism is foldably connected to the first top flap 14. The slide mechanism is made up of an upper portion 46 and a lower portion 48. The upper portion 46 and the lower portion 48 are foldably connected together, and the upper portion 46 is foldably connected to the first top flap 14. Importantly, although the lower portion 48 and the upper portion 46 are adjacent the second side panel 36 and third side panel 38, respectively, they are not connected. The lower portion 48 of the slide 44 includes stops 50, designed to prevent the slide from exiting the box 12 when formed.

Still referring to FIG. 1, the second top flap 16 includes a support 52. The support 52 is foldably connected to the second top flap 16 and in one embodiment, the support 52 includes lobes 54 extending toward the lower portion 48 of the slide 44. The support 52 is folded relative to the second top flap 16 such that when the blank 10 is folded into a box 12, the support 52 engages the lower portion 48 of the slide 44. In particular, the lobes 54 of the support 52 press against the lower portion 48 of the slide 44, which ensures that the lower portion 48 remains adjacent the opening 42 of the second side panel 36, thereby preventing the unintended release of the solid pourable product. To provide maximum pressure with minimum contact when the lower portion 48 is covering the opening 42, the lobes 54 preferably engage the lower portion 48 where it covers the second side panel 36 just beyond the opening 42.

In addition to the support 52, the second top flap 16 also includes a closure flap 56. The closure flap 56 is foldably connected to the second top flap 16, and is a conventional rounded-edged closure flap 56, except for the provision of a first thumb tab 58 at the connection between the second top flap 16 and the closure flap 58, which enables a user to easily open the second top flap 16 when the box 12 is formed.

A second thumb tab 60 is located at the connection between the upper portion 46 and the lower portion 48 of the slide 44. Although the second thumb tab 60 is the primary means of operating the box 12, causing the pourable product to be dispensed in a controlled manner through the opening 42 when the opening is uncovered by the slide 44, the first thumb tab 58 allows a user to open up the box 12 and empty the pourable product all at once.

Figure 14:
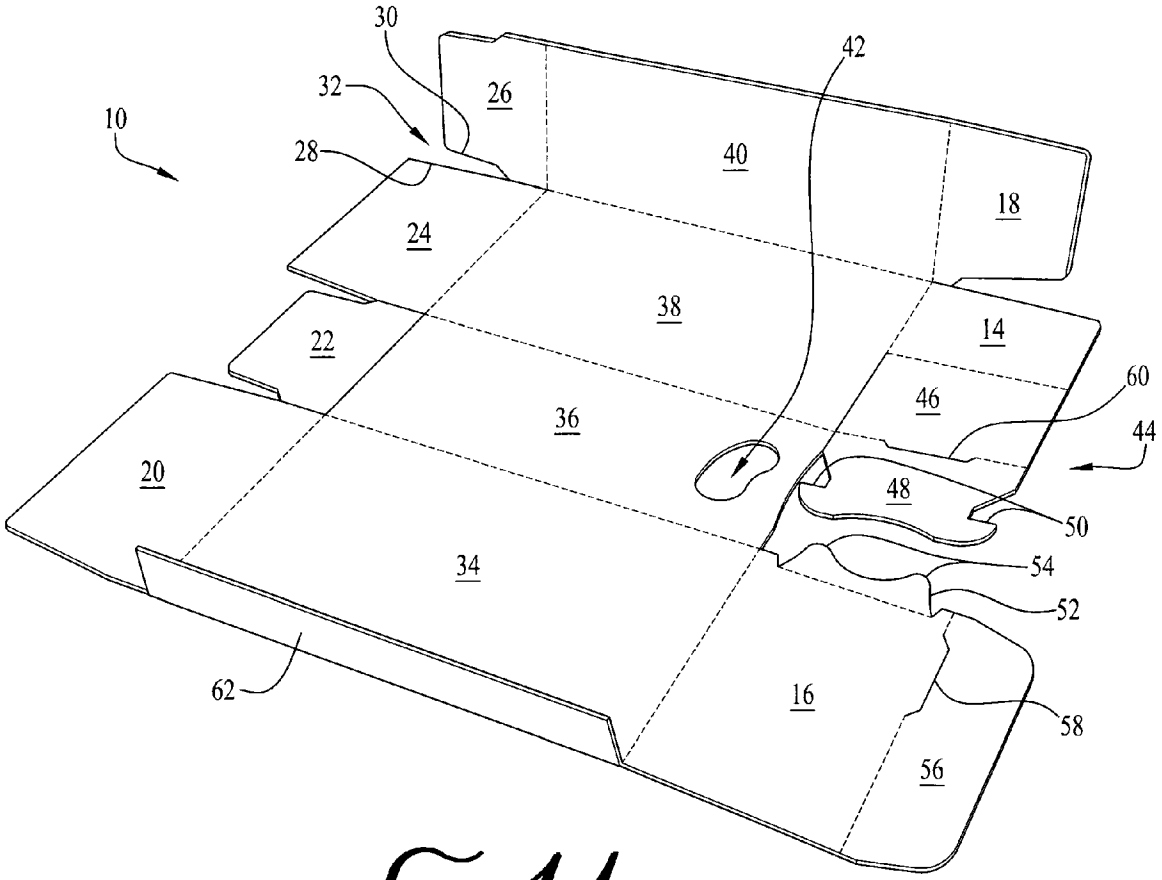
FIG. 14 illustrates a perspective view showing folding of the blank.

Referring to FIG. 14, the blank 10 is shown in the initial stages of folding. To hold the side panels 34, 36, 38, 40 in place when folded, an adhesive tab 62 is foldably connected to the first side panel 34. The adhesive tab 62 operates on the fourth side panel 40 to hold the first side panel 34 and the fourth side panel 40 in a foldably connected relationship when the fourth side panel 40 is fixed to the adhesive tab 62.

Figure 15:
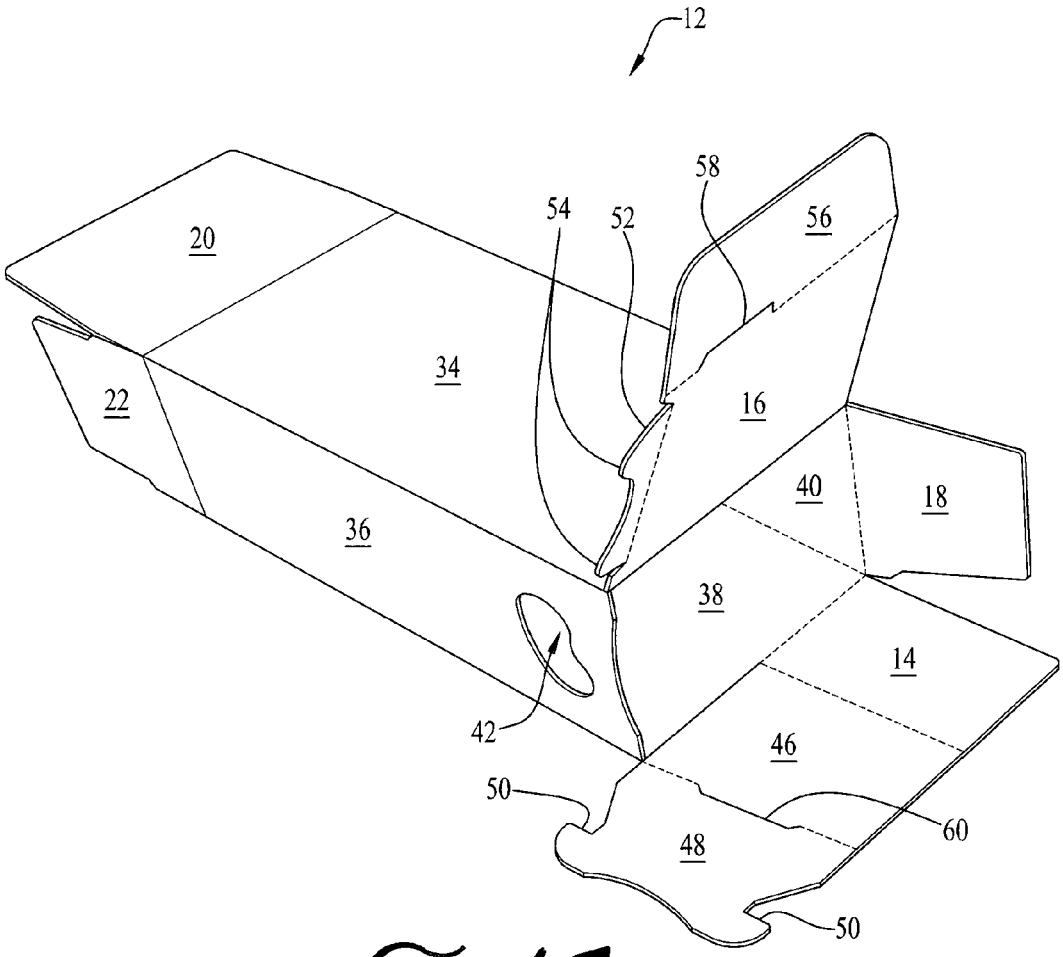
FIG. 15 illustrates a perspective view showing the blank folded into a tube box.
Figure 16:
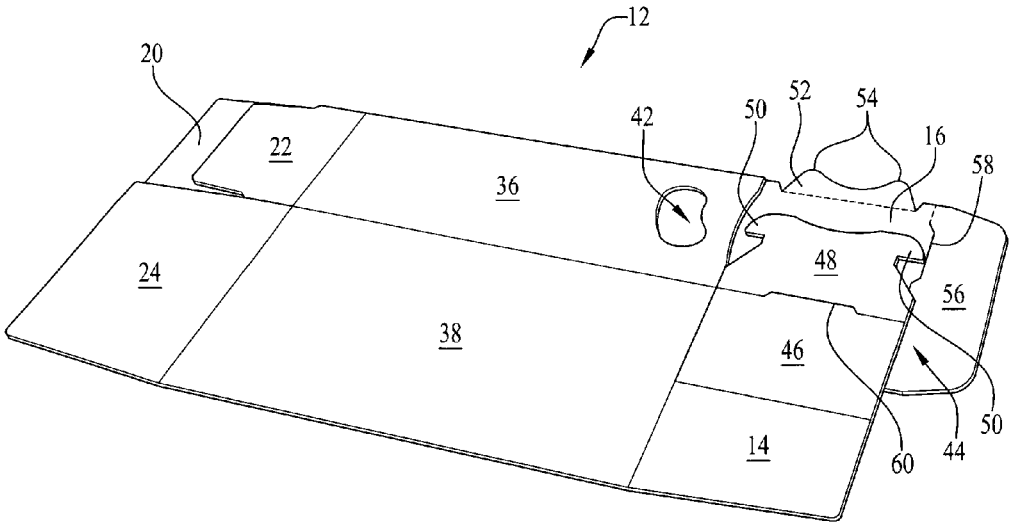
FIG. 16 illustrates a perspective view showing a flattened tube box.

Referring to FIG. 15, a tube box 12 is formed by adhering the adhesive tab 62 (not shown) to the fourth side panel 40. Also shown in this view are the upper portion 46 and lower portion 48 of the slide 44 extending from the first top flap 14, and the support 52 extending from the second top flap 16. Referring to FIG. 16, after adhesion, the box 12 is ready to be flattened so that multiple boxes 12 can be stacked and inserted into a cartoner (not shown) or similar machinery. When the box 12 is flattened, slide 44 extends from the box 12 no farther than the top flaps 14, 16, 18, allowing the box 12 to be used in conventional cartoners without modification.

Figure 17:
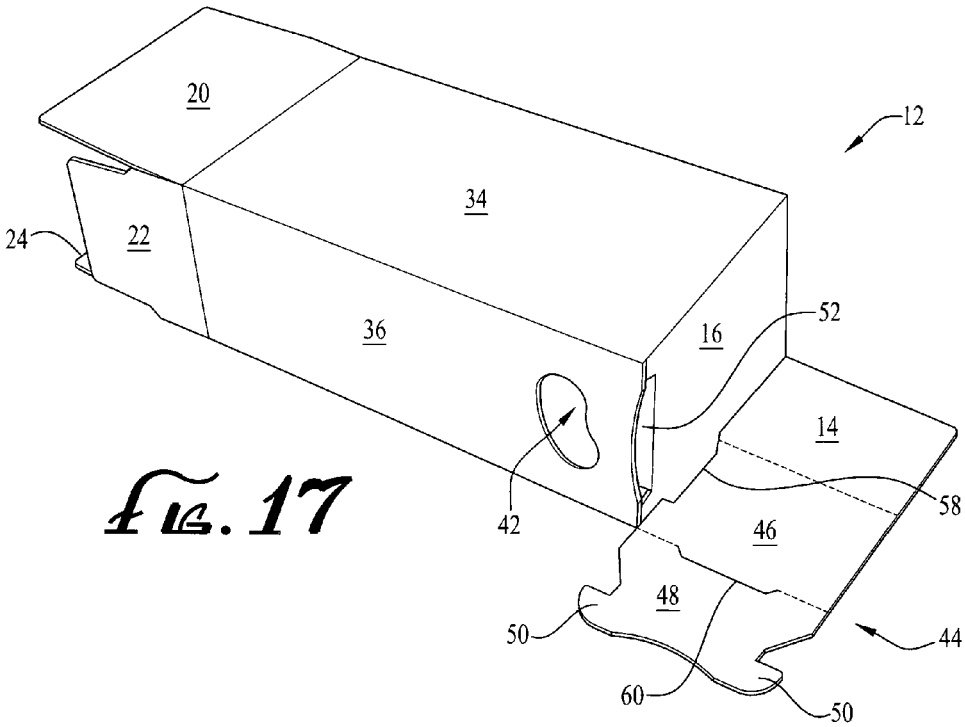
FIG. 17 illustrates a perspective view of a slide for the improved box being folded into position.

Referring to FIG. 17, after a flattened box 12 is folded into a three-dimensional box 12, the slide 44 may be constructed. First, the support 52 and the closure flap 56 (not shown) are folded relative to the second top flap 16. The second top flap 16 is then folded into position as shown. In the folded position, the support 52 engages the second side panel 36 with the lobes 54 (not shown). To provide a strong engagement, the support 52 is preferably set slightly back on the second top flap 16. This arrangement provides two advantages. First, the support 52 can be folded at a less extreme angle (i.e., less than 90 degrees), which discourages creasing and encourages resiliency. Second, once the box 12 is folded, any deformation will not cause portions of the box 12 to act on the support 52 and drive it away from the second side panel 36. After the second top flap 16 is folded into position, the first top flap 14, including the slide 44 may be folded into position. Thereafter, the box 12 may be filled with pourable product (not shown) and the bottom flaps 20, 22 (24, 26 not shown) closed with adhesive.

Figure 18:
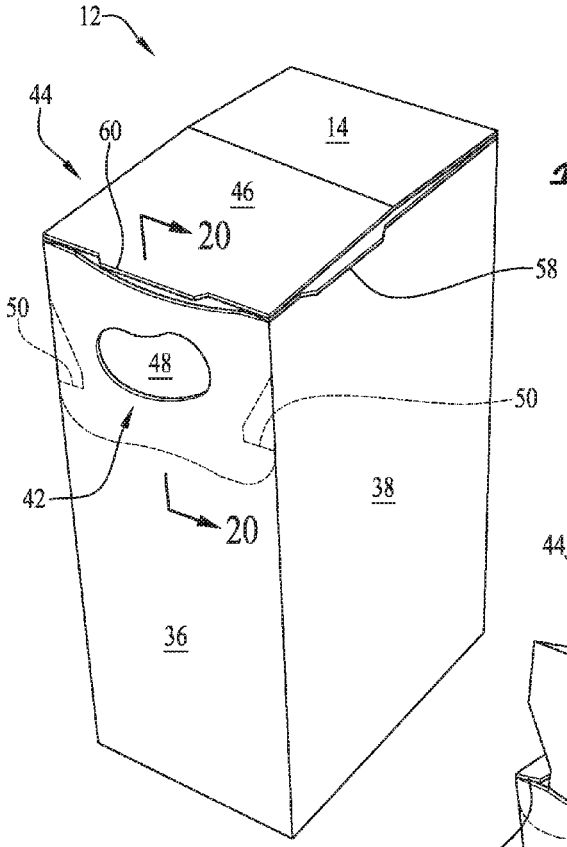
FIG. 18 illustrates a perspective view of the improved box in a closed state.

Referring to FIG. 18, the second top flap 16 is folded into position, and the first top flap 14 folded over the second top flap 16 (not shown). In the process, the upper portion 46 of the slide 44 is folded relative to the lower portion 48, and the lower portion 48 is inserted into the box 12 to cover the opening 44. When the lower portion 48 is slid into position, it comes between the support 52 (not shown) and the second side panel 36, and is held against the opening 42 by the support 52. The first top flap 14 is preferably adhered to, or otherwise attached to the second top flap 16 to hold the box 12 closed, and promote smooth operation of the slide 44.

Figure 19:
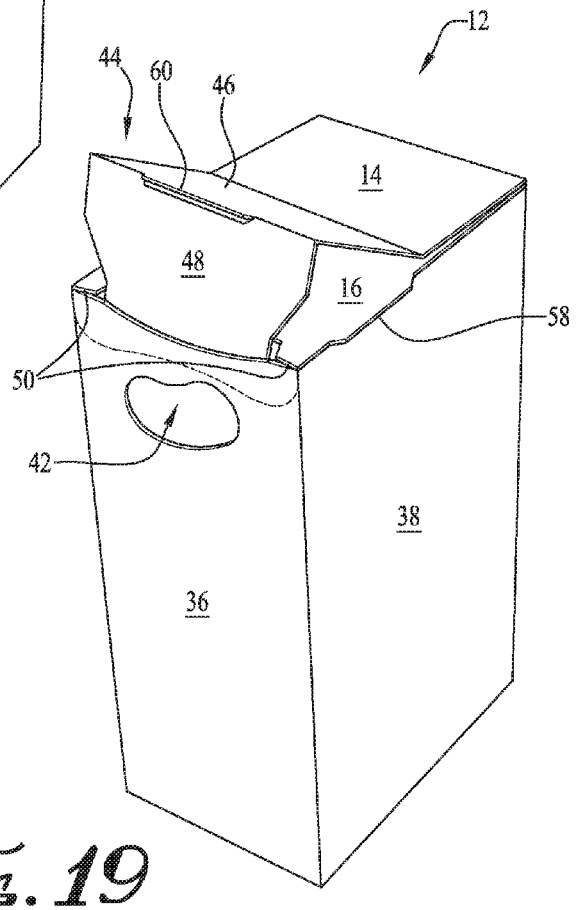
FIG. 19 illustrates a perspective view of the improved box in an open state.

Referring to FIG. 19, in order to open the box 12, a user simply engages and lifts the second thumb tab 60. This may be done using one hand (not shown) grasping the box 12 with the fingers and lifting the second thumb tab 60 with the thumb. As the thumb tab 60 is lifted, the upper portion 46 of the slide 44 folds relative to the first top flap 14, and the lower portion 48 of the slide 44 rises to clear the opening 42. If the user continues lifting the slide 44, eventually the stops 50 will engage the second top flap 16, preventing the slide 44 from exiting the box 12. With the opening 42 cleared, the user may dispense pourable product (not shown) from the box 12. Once dispensing is finished, the user can use the same thumb to press down on the slide 44, lowering the lower portion 48, which will obscure the opening 42 and be held against the opening 42 by the support 52 (not shown).

Figure 20:
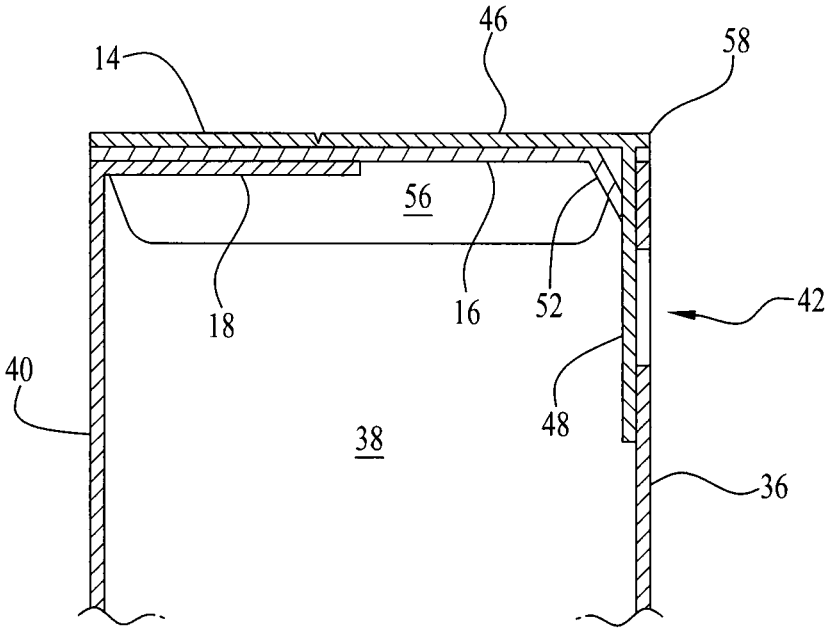
FIG. 20 illustrates a section view of the top portion of the improved box in a closed state.

Referring to FIG. 20, a section view of the inside of the box 12 is shown. In this view the lower portion 48 is shown covering the opening 42. The lower portion 48 is held against the opening 42 by the support 52, which is folded down from the second top flap 16, preferably at an angle less than ninety degrees. The second top flap 16 is folded over the third top flap 18, and is covered by the first top flap 14 and the upper portion 46. Since the second top flap 16 is held in place by being covered by the first top flap 14, and engaging the third side panel 38 using the closure flap 56, when the upper portion 46 is lifted, the support 52 will remain in position, allowing the box 12 to be opened and closed numerous times.

While particular forms of the invention have been illustrated and described, it will also be apparent to those skilled in the art that various modifications can be made without departing from the spirit and scope of the invention. Accordingly, it is not intended that the invention be limited except by the appended claims.

What is claimed is:

1. A package for solid pourable product, the package comprising:

a stock blank defining a one-piece pattern having a plurality of flap portions foldably extending from a plurality of longitudinally extending side panels, the flap portions of the pattern respectively defining top and bottom flaps and a slide for a box;

each of the flap portions of the pattern terminating at free edges, with opposing free edges of adjacent flaps being separated by a taper formed along at least one of said opposing free edges;

the slide having an upper portion foldably connected to a lower portion, the upper portion of the slide being foldably connected to a first top flap for the box;

a support engaging the lower portion, the support foldably connected to a second top flap of the box, the first and second top flaps extending from different side panels;

one of the side panels having an opening proximate the first top flap for the box;

the opening covered by the lower portion; and the second top flap of the box adhesively connected to the first top flap of the box;

wherein the support is disposed to press the lower portion against the side panel having the opening upon formation of the box.

2. The package of claim 1 wherein the lower portion slides between the second top flap and the one of the panels having an opening.

3. The package of claim 1 wherein a fold line between second top flap and the support is set back from the one of the panels having an opening.

4. The package of claim 1 wherein the support has two lobes contacting the lower portion.

5. The package of claim 1 wherein the upper portion overlies the second top flap.

6. The package of claim 1 wherein the opening is jellybean shaped.

7. The package of claim 1 wherein the box is a tube box.

8. The package of claim 1 wherein the top and bottom flaps of the box are sealed closed by an adhesive.

9. The package of claim 1 wherein the box has two or more major panels and two or more minor sides, and the opening is located in one of the minor sides of the box.

10. The package of claim 1 wherein the slide further comprises a stop member to contain the at least a portion of the slide inside the box.

11. The package of claim 1 wherein the slide includes a thumb tab.

12. The package of claim 1 wherein the second top flap includes a thumb tab.

13. The package of claim 1 wherein the box is constructed to lay flat upon opening the top the bottom flaps.

14. A package for solid pourable product comprising:

a blank stock defining a one-piece pattern for a box, the blank having a first top flap and a second top flap;

a first side panel foldably connected to the second top flap; a second side panel having an opening, and a third side panel foldably connected to the first top flap;

the first top flap foldably connected to a slide, the slide having an upper portion foldably connected to the first top flap and a lower portion foldably connected to the upper portion;

the second top flap foldably connected to a support, adjacent the third side panel; and the support biased to project toward the second side panel upon formation of the box, such that when the lower portion extends between the support and the second side panel, the support is disposed to push the lower portion against the opening in the second side panel.

15. The package of claim 14 wherein the folding connection between the support and the second top flap is set back from the third side panel.

16. The package of claim 14 wherein the support includes lobes for pressing on the lower portion with a minimum of surface area contact.

17. The package of claim 14 wherein the second top flap includes a closure flap insertable into the box.

18. The package of claim 14 wherein the first top flap is adhered to the second top flap.

19. The package of claim 14 wherein the lower portion includes stops for engaging the second top flap.

20. The package of claim 14 including a thumb tab between the upper portion and the lower portion.

* * * * *